United States Patent [19]

Kenyon et al.

[11] 4,181,237

[45] Jan. 1, 1980

[54] LIQUID STORAGE TANK WITH WELDED JOINT DRAIN CANAL SYSTEM AND WALL STIFFENER SYSTEM

[75] Inventors: John W. Kenyon, Bourbonnais; Lestle R. Shockley, Oak Forest; Paul R. Van Niel, Bourbonnais, all of Ill.

[73] Assignee: Chicago Bridge & Iron Company, Oak Brook, Ill.

[21] Appl. No.: 938,240

[22] Filed: Aug. 30, 1978

[51] Int. Cl.[2] ..... B65D 7/42; B65D 7/02; B65D 25/00

[52] U.S. Cl. ..... 220/71; 220/75; 220/5 A; 220/1 B; 220/85 S

[58] Field of Search ..... 220/71, 75, 80, 83, 220/85 S, 5 A, 1 B; 222/108, 109, 152

[56] References Cited

U.S. PATENT DOCUMENTS

| | | | |
|---|---|---|---|
| 1,899,755 | 2/1933 | Grigis | 220/75 |
| 2,598,160 | 5/1952 | Gruenais | 220/1 B |
| 2,683,914 | 7/1954 | Reimbert | 220/1 B |
| 3,225,953 | 12/1965 | Wolfe | 220/5 A |

*Primary Examiner*—Steven M. Pollard

*Attorney, Agent, or Firm*—Merriam, Marshall & Bicknell

[57] ABSTRACT

A liquid storage tank having a wall made of a plurality of metal plates having adjacent abutting edges joined together by at least vertical welded joints, at least some of the joints having an elongated tubular metal member with a surface in spanning contact with the welded joint for at least part of the joint length, a plurality of spaced apart holes in the tubular member surface, in contact with the metal plates, the joint being butt welded from one side with the tubular member in place spanning the other side of the joint, and the side edges of the tubular member surface being joined by a continuous weld to the adjacent metal plates.

9 Claims, 10 Drawing Figures

LIQUID STORAGE TANK WITH WELDED JOINT DRAIN CANAL SYSTEM AND WALL STIFFENER SYSTEM

This invention relates to storage tanks and to their construction. More particularly, this invention is concerned with improvements in tank wall structures to minimize wall distortion during construction and to collect liquid which may leak through tank joints.

Electric generating stations which utilize nuclear energy generally include a number of pools for handling the radioactive nuclear fuel. These pools are sometimes referred to as spent fuel pool, shipping cask pool, and decontamination pit. Pools are also used for refueling water storage. The pools are often interconnected by a fuel transfer walled canal. These pools and canal contain water for safe handling of the nuclear fuel.

The pools as described are generally contained within a tank which can be a free-standing metal shell formed of suitable metal plate, or it can be a metal liner supported by exterior concrete walls. Both types of metal shell, whether free-standing or supported, are intended to be included within the term "tanks" as used herein. Some of the tanks have vertical cylindrical walls while other tanks have walls which are basically vertical flat surfaces with the tanks being rectangular in horizontal section. The walls of the fuel transfer canal furthermore, which interconnect adjacent pools, are generally vertical flat surfaces.

The tank walls are generally made of a plurality of metal plates, usually stainless steel, positioned so that the edges are in end-to-end abutting position. The abutting edges are welded securely together to form a joint. The weld can be deposited from one or both sides of the wall.

Because the pools contain radioactive water, it is important for safety reasons to provide a means for controlling the drainage of any water which may leak through a defective welded joint. Current engineering practice thus requires that a drainage system be employed along the outside surface of the tank or shell wall around the welded joint to first receive any radioactive water which leaks by or through the welded joint and then to direct it to a suitable accumulating reservoir.

One prior art drainage system utilizes a series of metal channel members which are placed over the outside surface of the tank so that the channel flanges span the welded joint, whether it is vertical or horizontal. The end of each flange of each channel member is joined by a continuous weld to a plate edge portion on the side of the welded joint to thereby span the joint and provide a closed conduit into which leaking radioactive water can flow from leaks in the welded joints. This system does not provide for ready alignment of abutting edges of the plates and it also requires welding the joint from both sides of the wall or shell.

Another prior art system for tank wall structures employs a back-up bar which spans the joint. A butt weld is then deposited from the other or inside of the tank wall. An H-beam is then positioned over the back-up bar with two of the beam flange ends in contact with the plate portions on each side of the joint. Continuous welds then join the flanges of the H-beam to the tank wall surface. In this way a conduit drain is formed for receiving radioactive water which might leak through the welded joint. Since the H-beam is installed after the welded joint has been completed, the H-beam does not provide any stiffening of the plates during erection or during joint welding. This is also true with respect to the use of a channel member as previously described above.

The metal plates used for the tank walls are generally quite large and often are six feet wide and fifteen to twenty feet long, but generally are relatively thin. Metal liner plates, for example, may be only 3/16ths of an inch thick. Because of the thinness of the plates employed and their large area, it is inherently difficult to keep the tank walls smooth, flat or with any other previously determined geometric surface, since the tolerances for such surfaces is quite limited. Furthermore, the joint welding induces heat distortion of the plates, further complicating the proper assembly of the tank wall within close tolerances. The channel member and H-beam member used in the prior art drain systems do not provide tank wall plate reinforcement because they are not installed until after the joint is completed. There is accordingly needed improvements in tank wall structures which will provide simultaneous reinforcement and stiffening of the plates used for the tank wall during erection and constuction of the wall and welding of the joints, and which will also provide a drainage system for receiving liquid which leaks through any such joints to direct the liquid to a collecting reservoir.

SUMMARY OF THE INVENTION

According to the invention there is provided an improvement in a liquid storage tank having a wall made of a plurality of metal plates having adjacent abutting edges joined together by at least vertical welded joints, with the improvement comprising at least some of the joints having an elongated tubular metal member with a surface in spanning contact with a welded joint for at least part of the joint length, a plurality of spaced-apart holes in the tubular member surface in contact with the metal plates, the joint being butt welded from one side with the tubular member in place spanning the other side of the joint, and with the side edges of the tubular member surface being joined by continuous welds to the adjacent metal plates of the tank.

The tubular member simultaneously provides a backup bar which permits welding the butt joint from one side of the wall. The tubular member also facilitates alignment of the plate edges and, in addition, provides a reinforcing member to keep the metal plates flat and straight, or with some other predetermined geometrical surface, by restraining plate distortion which could otherwise be induced by the heat evolved in joint welding.

The tubular member desirably has a flat surface in contact with the plate portions adjacent the joint. Such a flat surface is inherently provided by a tubular member which is a parallelogram in lateral cross-section. A particularly suitable tubular member for use in the invention is one which is square in lateral cross-section.

The described system is useful on horizontal welded joints as well as on vertical joints. It is important, however, on tank walls which have both vertical and horizontal joints to provide an intersecting connection which will permit liquid which flows through a vertical tubular member to be directed into a horizontal tubular member so that flow of liquid can be directed to a collecting reservoir. Alternatively, it may be desirable to have the liquid flow from a horizontal tubular member into a vertical tubular member. In either system the purpose is to provide suitable passageways for ready flow of liquid which leaks through welded joints to be directed to a predetermined collecting reservoir.

A special splicing structure for tubular member intersections is provided according to the invention to connect the end of a tubular member which perpendicularly intersects another tubular member, whether the later is a vertical or horizontal tubular member. The end of the abutting tubular member is mitered or angled so that the back wall of the tube has an edge which is close to or in contact with the other tubular member rear surface. That back edge is then welded to the tank wall two edge portions adjacent the joint and to the other tubular member running perpendicular thereto. A trough-shaped cover is then placed over the entire mitered end of the tubular member. The entire peripheral edge of the trough-shaped cover is then welded to the two tubular members and to the two plates to complete the spliced connection and to make it liquid-tight.

DETAILED DESCRIPTION OF THE DRAWINGS

So far as is practical, the same elements or parts which appear in the various views of the drawings will be identified by the same numbers.

Figure 1:
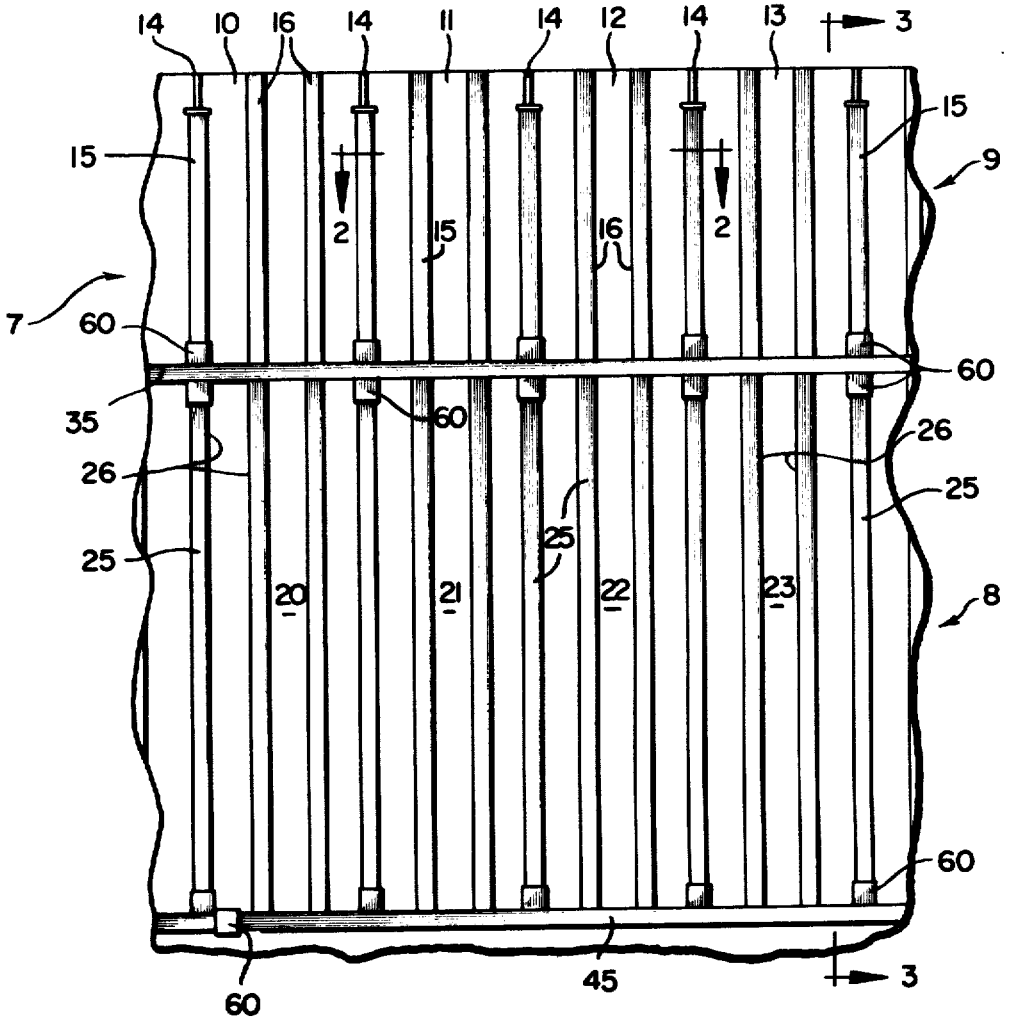
FIG. 1 is an elevational view of a part of a tank wall produced according to the invention.

FIG. 1 shows the exterior of a wall section 7 of a tank structure. This section of the wall is vertical and essentially flat surfaced on the interior. Tank wall section 7 has an upper course 9 made of identical rectangular metal plates 10, 11, 12 and 13. The upper course 9 of plates rests on a lower course 8 of plates 20, 21, 22 and 23, which are longer than, but of the same width, as the plates in the upper course. The vertical joints 14 between the edges of adjacent plates in the top course 9 are in alignment with similar joints between the plates of the lower course 8. Identical tubular members 15, which are square in horizontal cross section, span the width of each joint 14. Similarly, vertical tubular members 25, identical in cross-section to the tubular members 15, span the joints between the plates in the lower course 8.

Figure 2:
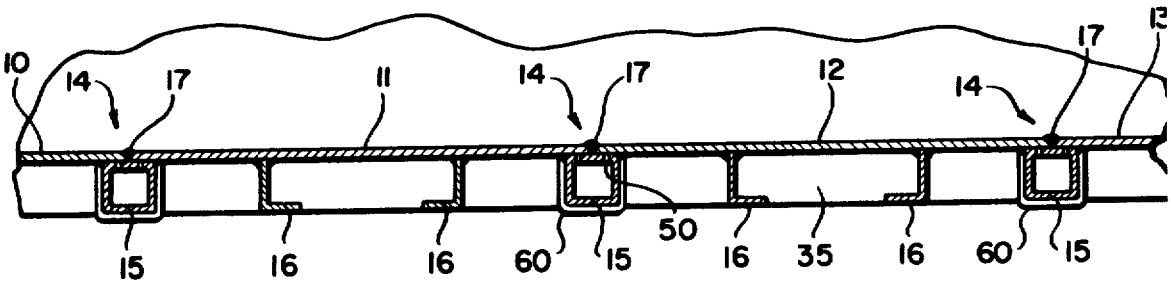
FIG. 2 is a sectional view taken along the line 2—2 of FIG. 1.

Each plate in the upper course 9 has a pair of vertically positioned reinforcing angle members 16 welded thereto, and the lower course 8 has a pair of similar reinforcing angle members 26 welded to the back thereof as is shown in FIGS. 1 and 2.

Figure 3:
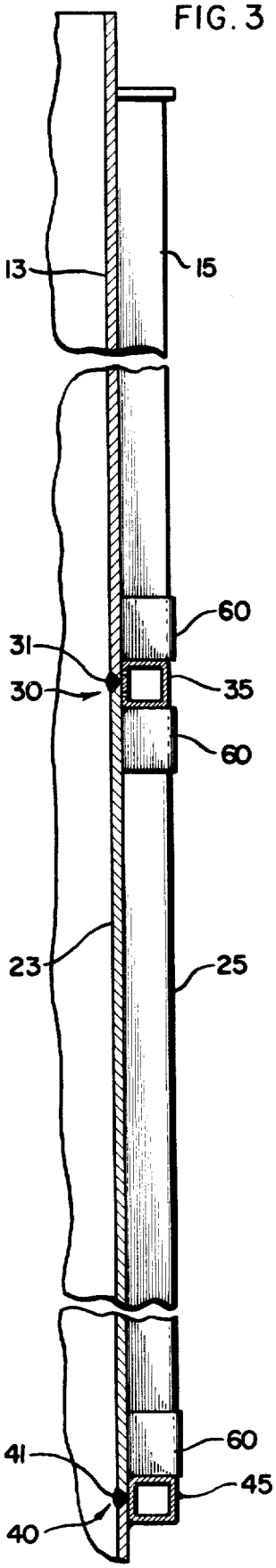
FIG. 3 is a vertical sectional view taken along the line 3—3 of FIG. 1.

The horizontal joint 30 (FIG. 3) between the plates of the upper course 9 and the lower course 8 is backed by horizontal tubular member 35. A similar horizontal tubular member 45 is positioned at the back of joint 40, as shown in FIG. 3, at the bottom of course 8.

Figure 4:
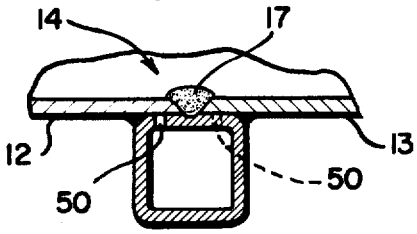
FIG. 4 is a horizontal sectional view through a vertical tubular member in back of a vertical welded joint.

The edges of the plates in courses 8 and 9 are joined by a butt weld 17 (FIG. 4) deposited from the inside of the wall section with the tubular members 15 and 25 having been previously put in position with a surface thereof in contact with the adjacent portions of the two abutting plates. Similarly, butt weld 31 (FIG. 3) is deposited to join together the edges of the plates forming courses 8 and 9 after the horizontal tubular member 35 is placed in position. The horizontal weld 41 at the bottom of lower course 8 is also deposited after the horizontal tubular member 45 is put in position in back of the joint 40. Each of the tubular members 15, 25, 35 and 45 is desirably tack welded to the adjoining plate surfaces before the butt welds are deposited to join the plate edges together to make joints 14, 30, and 40.

Figure 5:
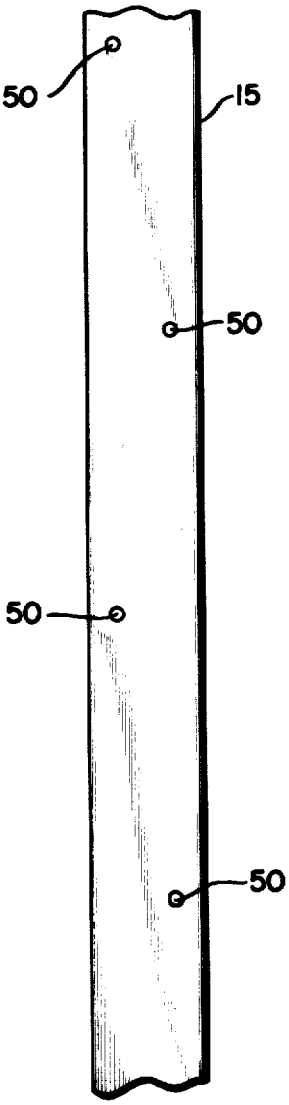
FIG. 5 is a rear view of a tubular member showing the staggered spaced-apart drain holes.

Each of the tubular members 15, 25, 35 and 45 is provided with a plurality of staggered, spaced-apart drainage holes 50 positioned such as shown in tubular member 15 illustrated by FIG. 5. The holes 50 may be drilled, punched or burned into the metal as may be appropriate.

Figure 6:
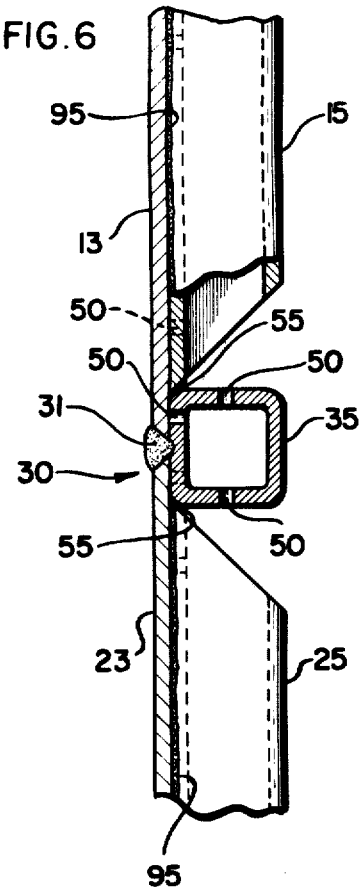
FIG. 6 is an elevational view partially in section showing the intersection of two vertical tubular members with a horizontal member and the mitered ends of the vertical tubular members adjoining the horizontal member.
Figure 7:
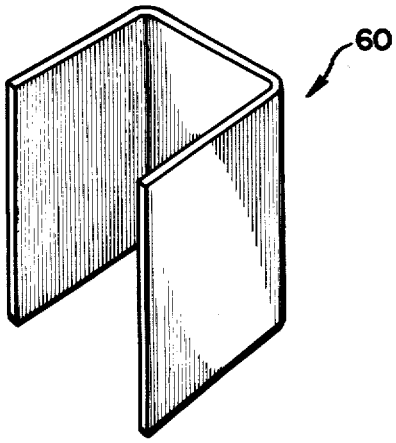
FIG. 7 is an isometric view of a trough-shaped cover which is placed over the mitered ends of the tubular members.
Figure 8:
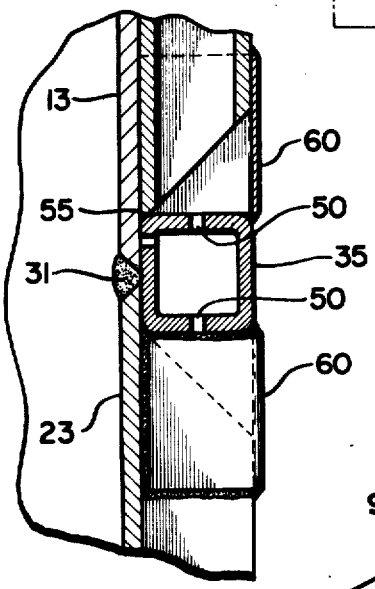
FIG. 8 is like FIG. 6, but with trough-shaped covers positioned over the mitered ends of the vertical members.

As shown in FIG. 6, the lower end of tubular member 15 and the upper end of tubular member 25 is mitered at an angle of about 45°. This is done so that a weld 55 can be deposited to join the back edge of these tubular members to the tank wall plates and to the horizontal tubular member 35. No such weld could be deposited if the ends of the tubular members were squared off at their intersection with the horizontal tubular member 35, since access to the rear wall of the tubular members 15 and 25 for welding would thus be barred. After the welds 55 are deposited, a troughshaped three-sided cover 60 (FIG. 7) is positioned over the mitered ends of tubular members 15 and 25, as is shown in FIG. 8. The entire peripheral edge of each cover 60 is then welded to the adjacent tubular members and to the plates forming the tank wall. It should be understood that the described mitered joint structure can be used whether the horizontal or the vertical member continues through the intersection uninterrupted, with the other tubular member end containing the mitered joint abutting perpendicular thereto.

Figure 9:
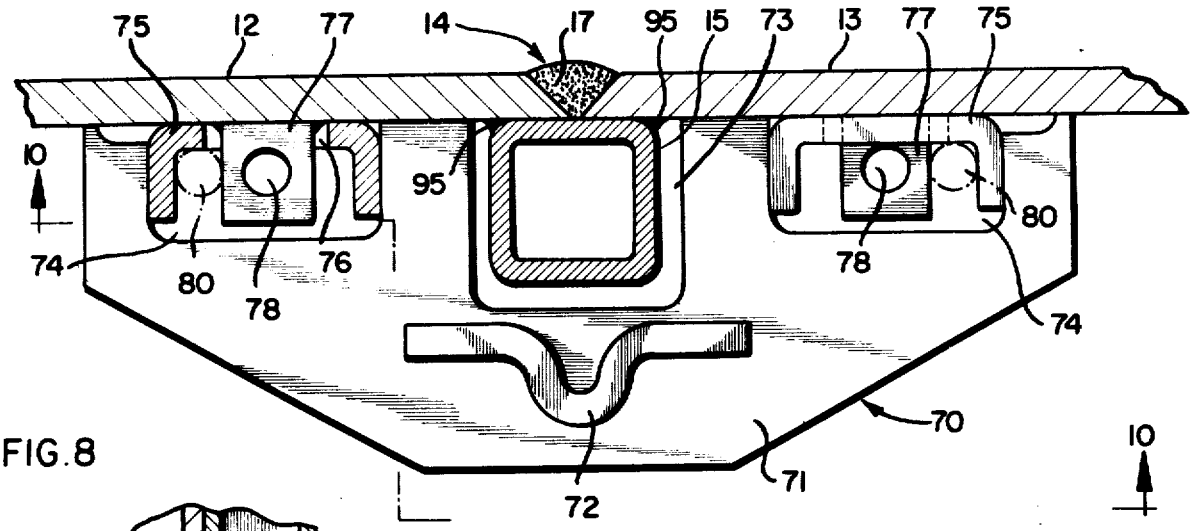
FIG. 9 is a plan view partially in section of a keyplate used to secure edge portions of adjacent plates in alignment for making a welded joint, and with a tubular member positioned in back of the abutting edges of the plates; and, FIG. 10 is a view taken along the line 10—10 of FIG. 9.
Figure 10:
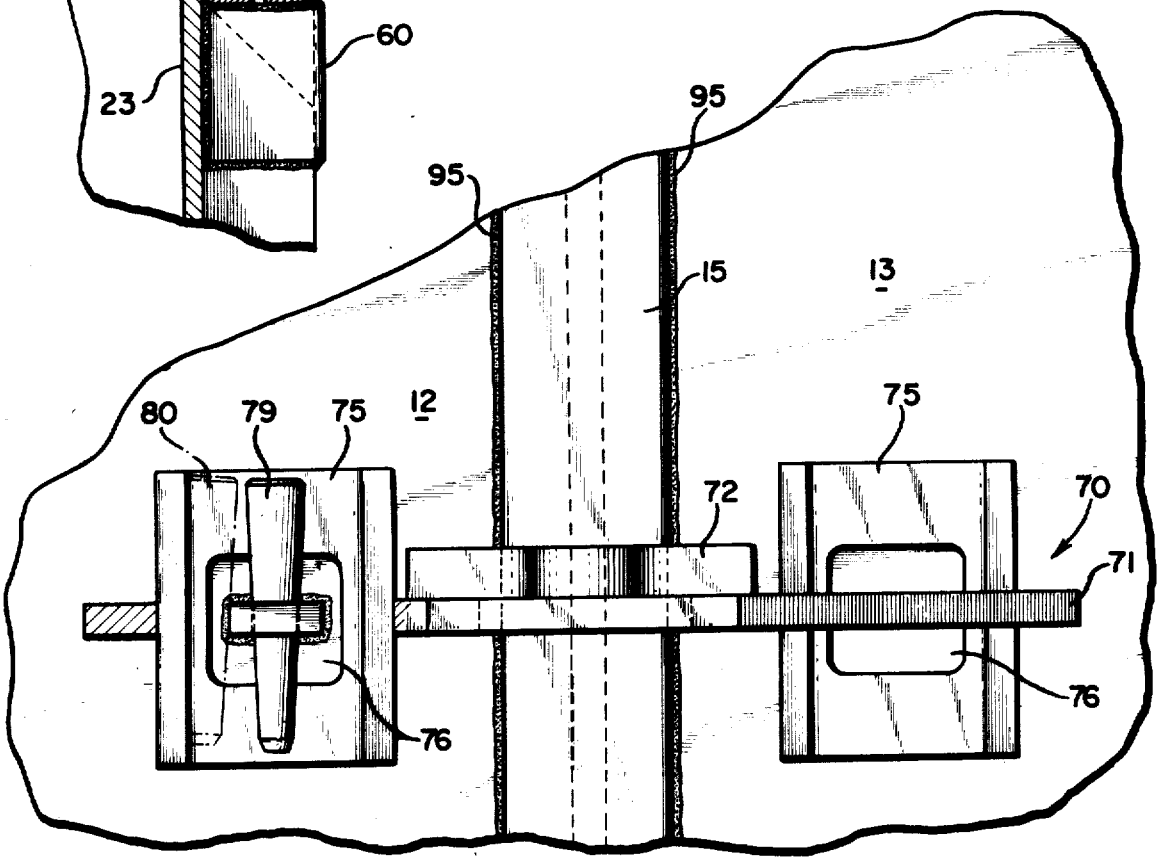

FIGS. 9 and 10 illustrate how the plates forming the tank wall can be assembled for welding with the tubular members properly positioned. A series of key plates 70 spaced about four feet apart are used to hold adjoining tank wall plates, such as plates 12 and 13, in proper position so that a joint 14 can be made by deposit of a weld 17. Each of the key plates has a flat plate 71 with a reinforcing rib 72. A centrally located slot 73 in plate 71 is made oversized to receive the tubular members, such as 15, so as to be able to move the key plate horizontally with respect to the tubular member. Two spaced apart slots 74 are also provided in the front edge of plate 71. In those slots are positioned vertical U-shaped members 75. Each U-shaped member has a square hole 76 into which a nut 77 can project. Each nut 77 is welded along one side to the outer surface of a tank wall plate 12, 13 or the like. A non-threaded hole 78 in each nut 77 is sized to receive a tapered bull pin 79 as shown in FIG. 10. A similar bull pin 80 can be used on either side of each of the nuts 78 to help position the key plate 70 relative to each of the wall plates 12 and 13, and to facilitate moving the tank wall plates relative to each other to get the proper gap between the plate edges for depositing the weld 17. Once the tank wall plates are properly positioned relative to each other and the tubular member 15 is located properly, suitable tack welds can be used to temporarily hold the plates and tubular element together. Then the joint weld 17 can be deposited following which welds 95 can be deposited along both side edges of the tubular member 15 in contact with the tank wall plates 12 and 13. This procedure is followed in making most, if not all, of the joints.

This detailed description has been given for clearness of understanding only, and no unnecessary limitations should be understood therefrom, as modifications will be obvious to those skilled in the art.

What is claimed is:

1. In a liquid storage tank having a wall made of a plurality of metal plates having adjacent abutting edges joined together by at least vertical welded joints, the improvement comprising:

at least some of the joints having an elongated tubular metal member with a surface in spanning contact with the welded joint for at least part of the joint length, a plurality of spaced apart holes in the tubular member surface, in contact with the metal plates, the joint being butt welded from one side with the tubular member in place spanning the other side of the joint, and the side edges of the tubular member surface being joined by a continuous weld to the adjacent metal plates.

2. The improvement according to claim 1 in which the tubular member is a parallelogram in lateral cross-section.

3. The improvement according to claim 2 in which the parallelogram is a square.

4. In a liquid storage tank having a wall made of a plurality of metal plates having adjacent abutting edges joined together by at least vertical and horizontal welded joints, the improvement comprising:

A. at least some of the vertical joints having an elongated tubular vertical metal member with a surface in spanning contact with the metal plate portions by the vertical welded joint for at least part of the joint length, a plurality of spaced apart holes in the vertical tubular member surface in contact with the metal plates, the vertical joint being butt welded from one side with the vertical tubular member in place spanning the other side of the joint, and the side edges of the vertical tubular member being joined by a continuous weld to the adjacent metal plates, and B. at least one of the horizontal joints having an elongated tubular horizontal metal member with a surface in spanning contact with the metal plate portions by the horizontal welded joint for at least part of the joint length, a plurality of spaced apart holes in the horizontal tubular member surface in contact with the metal plates, the horizontal joint being butt welded from one side with the horizontal tubular member in place spanning the other side of the joint, and the side edges of the horizontal member being joined by a continuous weld to the adjacent metal plates.

5. The improvement according to claim 4 in which the vertical tubular members intersect with the horizontal member and the interior of the vertical and horizontal members are in liquid flow communication with each other.

6. The improvement according to claim 5 in which at least some of the vertical tubular members end in contact with the horizontal tubular member, the ends of the vertical tubular members are mitered to have only the rear end edge thereof adjacent the horizontal tubular member, the said rear end edge is welded to the plates and the horizontal member, and a trough shaped cover placed over and covering the entire mitered end of the vertical tubular member is welded about its entire periphery to the plates, vertical tubular member and the horizontal tubular member.

7. The improvement according to claim 6 in which the horizontal member is between and in contact with the top and bottom ends of vertical tubular members.

8. The improvement according to claim 4 in which the vertical tubular members intersect with the horizontal member and the interior of the vertical and horizontal members are in liquid flow communication with each other.

9. The improvement according to claim 8 in which at least the horizontal tubular member ends in contact with a vertical tubular member, the end of the horizontal tubular member is mitered to have only the rear end edge thereof adjacent the vertical tubular member, the said rear end edge is welded to the plates and to the vertical member, and a trough shaped cover placed over and covering the entire mitered end of the horizontal tubular member is welded about its entire periphery to the plates, vertical tubular member and the horizontal tubular member.

* * * * *